US007878436B2

(12) United States Patent
Wang

(10) Patent No.: US 7,878,436 B2
(45) Date of Patent: Feb. 1, 2011

(54) SHREDDER SUPPORT AND WASTE RECEPTACLE

(75) Inventor: Tie Chun Wang, Taipei (TW)

(73) Assignee: Michilin Prosperity Co., Ltd. (TW)

( * ) Notice: Subject to any disclaimer, the term of this patent is extended or adjusted under 35 U.S.C. 154(b) by 687 days.

(21) Appl. No.: 11/511,966

(22) Filed: Aug. 29, 2006

(65) Prior Publication Data

US 2008/0054110 A1 Mar. 6, 2008

(51) Int. Cl.
*B02C 18/16* (2006.01)

(52) U.S. Cl. ..... 241/100; 241/285.2

(58) Field of Classification Search ..... 241/100, 241/285.1, 285.2; 220/23.87, 23.89, 23.86, 220/23.83

See application file for complete search history.

(56) References Cited

U.S. PATENT DOCUMENTS

| | | | | |
|---|---|---|---|---|
| 5,269,473 | A * | 12/1993 | Strohmeyer et al. | 241/100 |
| 7,114,629 | B2 * | 10/2006 | Panek, Jr. | 220/345.1 |
| D542,999 | S * | 5/2007 | Japuntich et al. | D34/27 |
| 2004/0222335 | A1 * | 11/2004 | Panek, Jr. | 248/129 |
| 2007/0187536 | A1 * | 8/2007 | Ko | 241/100 |
| 2008/0041986 | A1 * | 2/2008 | Ko | 241/100 |

* cited by examiner

*Primary Examiner*—Faye Francis
(74) *Attorney, Agent, or Firm*—Venable LLP; Stefan J. Kirchanski; Deborah A. Feinblum

(57) ABSTRACT

The present invention relates generally to the support system and waste receptacles for shredders. By removing certain supports in a shredder, the waste receptacle can be enlarged. In addition, openings in the shredder support walls allow the size of the waste receptacle to be increased, as well as facilitate disposal of other waste through the opening.

1 Claim, 6 Drawing Sheets

SHREDDER SUPPORT AND WASTE RECEPTACLE

BACKGROUND OF THE INVENTION

1. Field of the Invention

The present invention relates generally to shredders. Specifically this invention discloses various bases that support shredders, as well as the shredder waste receptacles that fit within the base.

2. Background Information

With increased privacy concerns shredders have become an integral part in both homes and businesses. Though originally used to destroy paper products, shredders are now used for other forms of media that hold information, such as compact discs. In addition, credit cards and other plastic products are commonly shredded.

Material that is shredded accumulates in the waste receptacle portion of the shredder. The size of the waste receptacle is typically limited by the walls that support the shredder mechanism.

In order to increase the amount of material that can be held in the shredder waste receptacle, the present invention removes certain walls that support the shredder mechanism. With the removal of the walls, the size of the shredder waste receptacle is no longer constrained.

In addition, with increased environmental concerns, it is advantageous to reduce or minimize the amount of material needed to build shredders. This is achieved through the removal of certain walls that support the shredder mechanism. This can likewise be achieved by actually reducing the amount of material used for the supporting walls by implementing openings in the supporting walls. Since less material is needed to make the shredder manufacturing costs are also decreased. In addition, the waste receptacle can be extended beyond the opening in the supporting walls such that other waste can be readily disposed of in the waste receptacle.

From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to an apparatus that satisfies the need for an increased waste receptacle in a shredder. In one preferred embodiment, a shredder having features of the present invention comprises a base with only one or two supporting walls. The bottom of the base has either male or female aligning members to align the waste receptacle in the base. In another preferred embodiment, the supporting walls have openings which both save resources and decreases manufacturing costs. In addition, the size of the waste receptacle can be increased by extending into the openings. Finally, the waste receptacle can be further extended out beyond either the periphery of the shredder housing or the openings in the supporting walls so that other waste may be disposed of in the waste receptacle.

All of the foregoing operational principles and advantages of the present invention will be more fully appreciated upon consideration of the following detailed description with reference to the drawings.

BRIEF DESCRIPTION OF THE DRAWINGS

The features and advantages of this invention are better understood with regard to the following drawings, description, and claims. The drawings consist of the following:

DETAILED DESCRIPTION OF THE INVENTION

Figure 1:
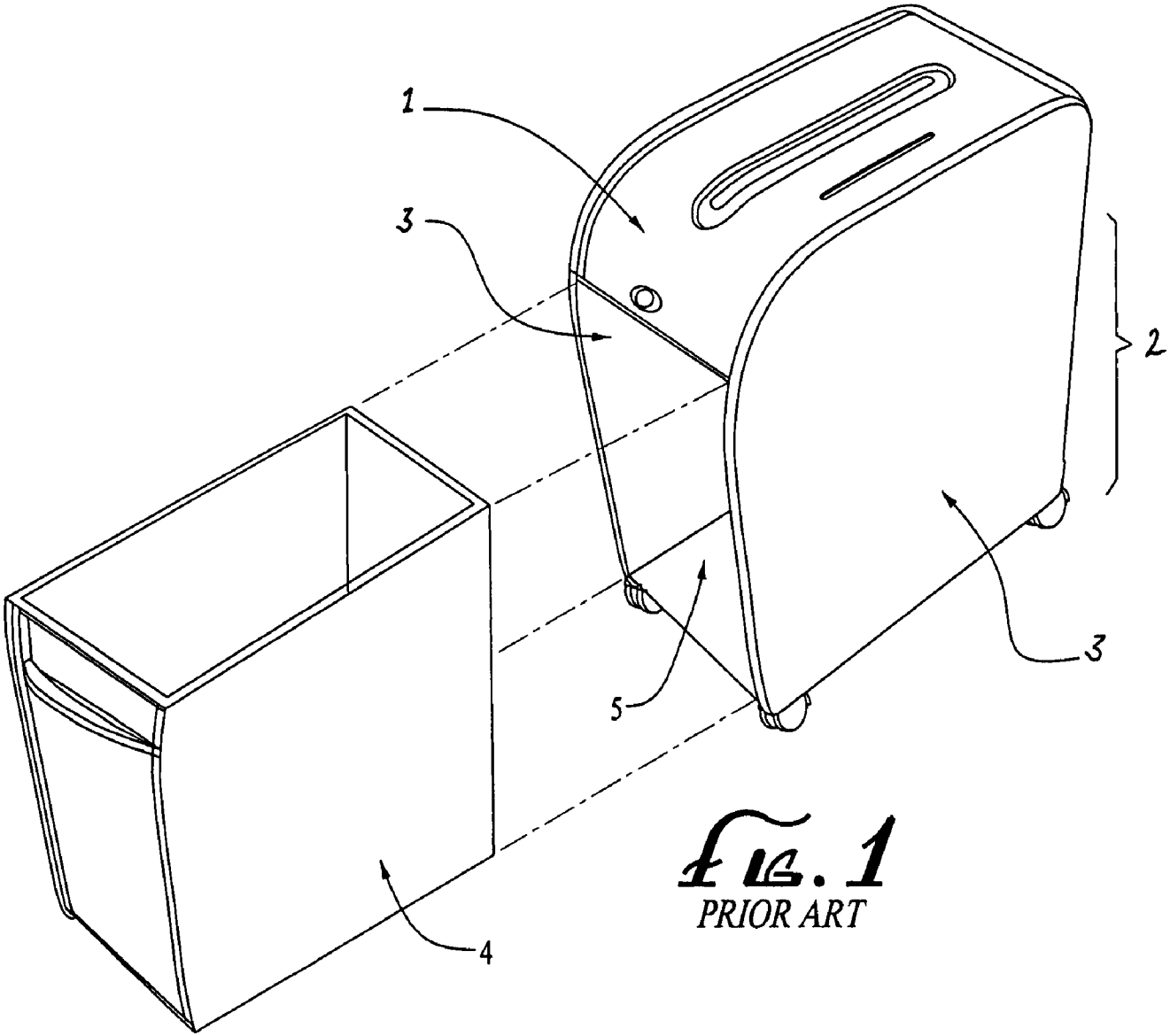
FIG. 1 PRIOR ART
FIG. 1 is a perspective view of an apparatus embodying the prior art.

This invention discloses a paper or media shredder which eliminates portions of the supporting structure thus allowing for maximization of waste receptacle size. As seen in FIG. 1, the essential elements of the prior art are comprised of a housing 1 for a shredder mechanism, a shredder mechanism (not shown), a base 2 with three supporting walls 3, and a waste receptacle 4. The shredder mechanism and housing 1 can be of any sort commonly known to those skilled in the art and is thus not described herein.

As shown in FIG. 1, the prior art consists of a base 2 with a base bottom 5 and three supporting walls 3 (the third supporting wall is the back wall of the base). The waste receptacle 4 fits on the base bottom 5 and within the supporting walls 3, abutting each supporting wall. The width of the waste receptacle 4 thus can be no larger than the constraints of the side supporting walls 3. In addition, the depth and height of the waste receptacle 4 is limited by the back supporting wall 3 and the base bottom, respectively.

Figures 2, 3:
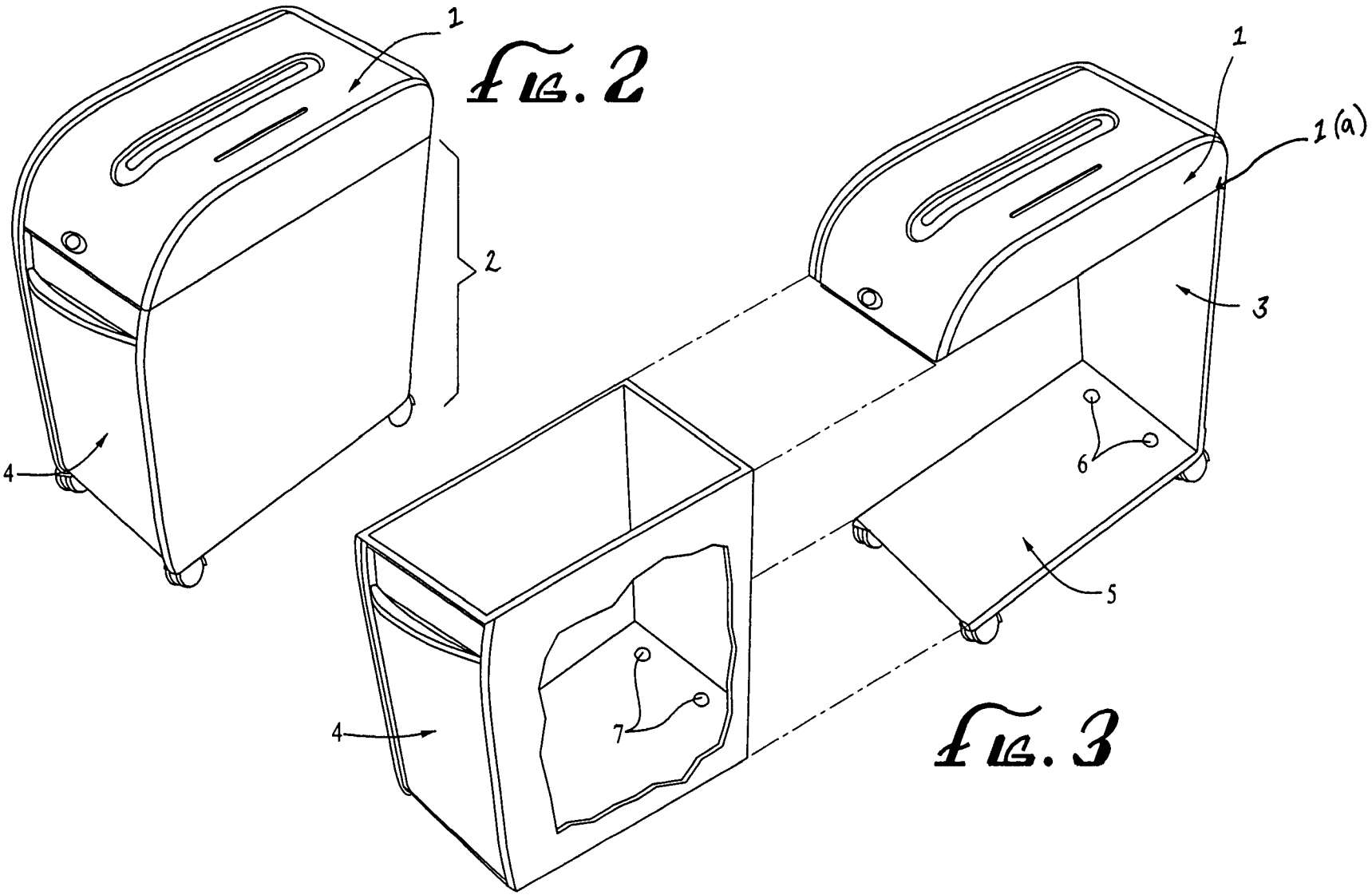
FIG. 2 is a perspective view of an apparatus embodying features of this invention.
FIG. 3 is a perspective view of the waste receptacle and shredder with one supporting wall for an apparatus embodying features of this invention.

FIGS. 2 and 3 disclose a preferred embodiment of this invention. The shredder is comprised of a housing 1 for a shredder mechanism, a shredder mechanism (not shown), a base 2, and a waste receptacle 4, which fits within the base 2 and underneath the housing 1.

The base 2 consists of a supporting wall 3 and a base bottom 5. In this preferred embodiment, the base 2 is comprised of only one supporting wall 3 which is coupled to the bottom of the periphery of the housing 1. The supporting wall 3 is comprised of a material of sufficient strength and durability to support the housing 1 and shredder mechanism. Preferably, the supporting wall 3 is coupled to at least 15% of the periphery of the housing 1.

For purposes herein, the supporting wall(s) may be said to support a certain percentage of the periphery of the housing. These percentages are determined by measuring the distance around the periphery of the bottom of the housing and then comparing it to the distance around the periphery of the bottom of the housing that the supporting wall is coupled to. The bottom of the periphery of the housing is located at the juncture where the housing couples to the supporting wall (see FIG. 3, 1(*a*)). For example, in the single wall embodiment, if the housing is a perfect square, then one supporting wall would be coupled to 25% of the periphery of the housing.

Certain shredders do not have a clear demarcation where the supporting wall and housing are coupled. In these instances the housing periphery is simply measured around the top of the base opening in which the waste receptacle is inserted. By way of example, in FIG. 3, this measurement occurs at the same place that the housing couples to the supporting wall (see 1(*a*)).

It is also possible for the supporting wall 3 to simply be a rod of steel or other like material. In such embodiments, the supporting wall 3 may only be coupled to a very small percentage of the housing periphery; as little as 1% of the periphery of the housing. Conversely, in quadrilateral embodiments such as this, one supporting wall may be coupled to up to 45% of the periphery of the housing depending on the shape and configuration of the base to the housing.

The strength of the material needed for the supporting wall 3 will depend on the percentage of the housing periphery that the supporting wall 3 is connected to. As detailed above, when the supporting wall 3 is connected to a small percentage of the periphery, a stronger, more durable material, such as steel is preferred. As a greater percentage of the periphery is supported, other materials such as wood, or those that fall in the category of plastics, such as ABS, PP, or high PS may be used.

The base bottom 5 has at least one protrusion which constitutes a male aligning member 6. This male aligning member 6 is capable of interacting with a depression in the bottom of the waste receptacle (female member 7). It should be appreciated that other embodiments are possible for aligning the waste receptacle 4 with the base bottom 5, including but not limited to placing a depression or female aligning member on top of the base bottom 5 and protrusion or male aligning member on the waste receptacle bottom.

As demonstrated in this embodiment, the waste receptacle is no longer limited in size by the supporting walls 3 (compare to FIG. 1). When the waste receptacle 4 is placed inside the base 2, the waste receptacle 4 abuts the rear supporting wall. Where there are no supporting walls 3, the width of the waste receptacle is increased such that it aligns with the periphery of the housing 1, as seen in FIGS. 2 and 3. In the prior art, the supporting walls 3 prevented the width of the waste receptacle 4 from aligning with the periphery of the housing 1. Instead the waste receptacle 4 was constrained by the supporting walls 3 and could only abut each supporting wall.

Other preferred embodiments include increasing the width of the waste receptacle 4 by extending either or both sides of the waste receptacle 4 beyond the width of the periphery of the housing 1, such that other materials can be readily disposed of through the opening between the housing periphery and the extended out side of the waste receptacle 4 (not shown).

Figure 4:
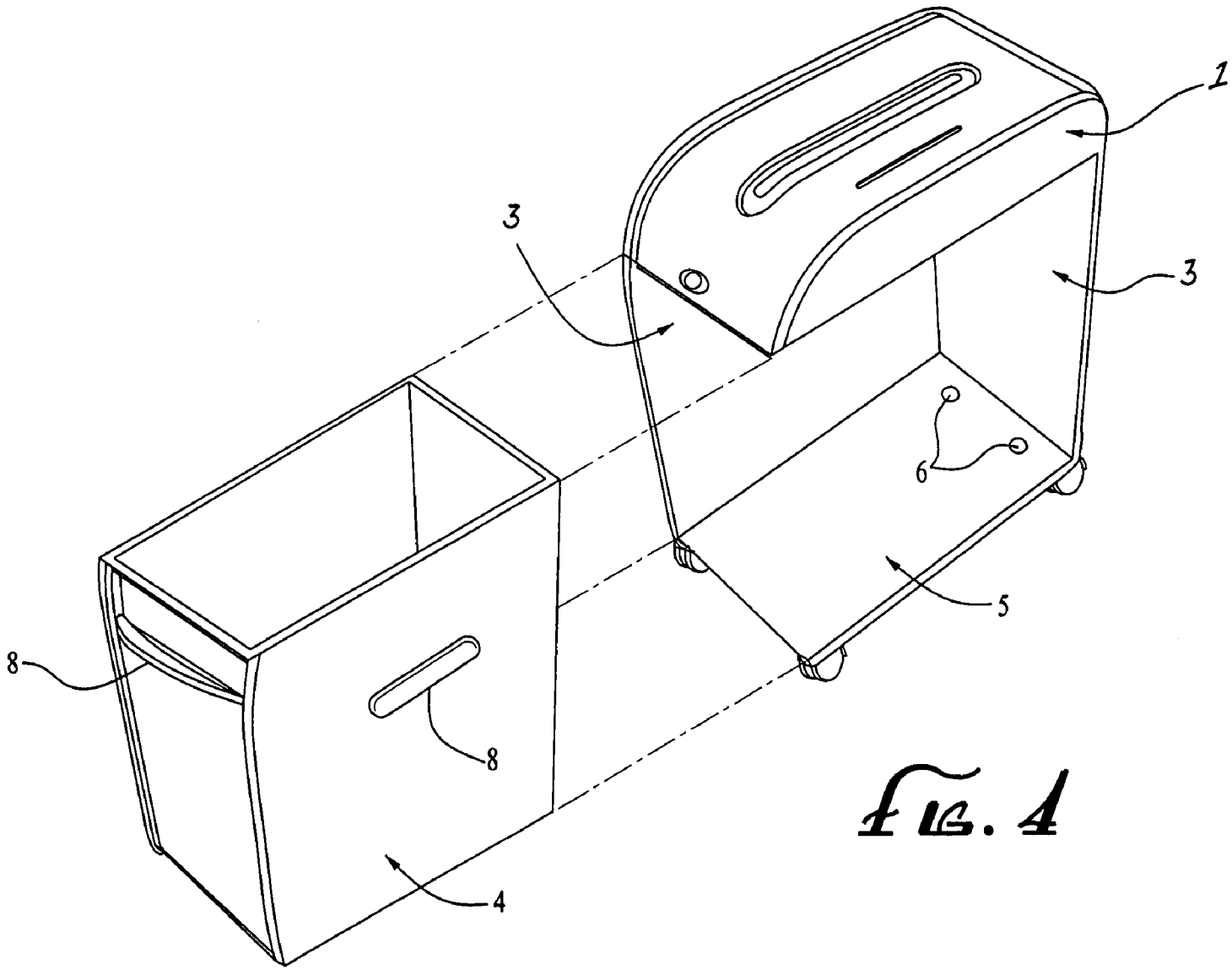
FIG. 4 is a perspective view of the waste receptacle and two supporting walls for another apparatus embodying features of this invention.

FIG. 4 discloses another preferred embodiment of this invention with two supporting walls 3. In this quadrilateral embodiment the two supporting walls 3 are coupled with approximately 50% of the periphery of the housing 1. It should be appreciated that the supporting walls 3 may be coupled to between 35% and 65% of the periphery of the housing 1, depending on the configuration of this quadrilateral embodiment.

When the waste receptacle 4 is placed inside the base 2, it abuts both supporting walls 3 and in the areas where there are no supporting walls, aligns with the outermost periphery of the housing. Other embodiments include extending the waste receptacle side beyond the housing periphery such that other waste can be discarded through the opening left between the waste receptacle 4 and the housing periphery.

In addition, a handle 8 may be placed on the side of the waste receptacle 4 as well as the front, in order to allow removal of the waste receptacle 4 from different angles. At least two handles may be readily placed in the embodiments of FIGS. 2 and 3 as well.

Finally, the base bottom may have at least one male aligning member capable of aligning to the female aligning member of the waste receptacle 4, or vice versa.

Figure 5:
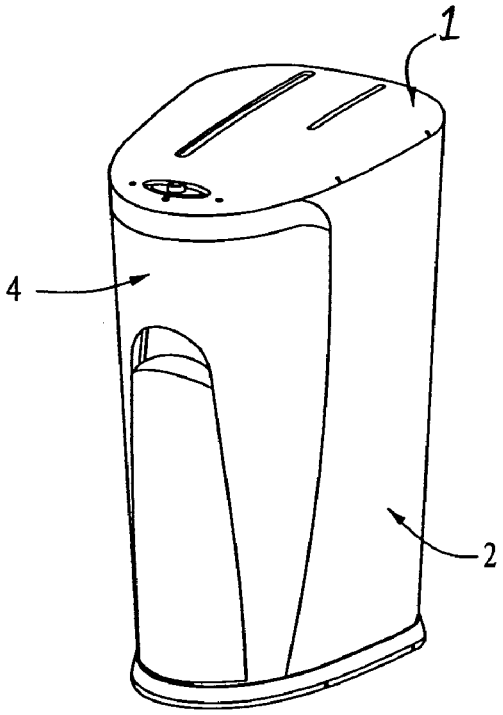
FIG. 5 is a perspective view of an apparatus embodying features of this invention with an opening in the supporting wall.
Figure 6:
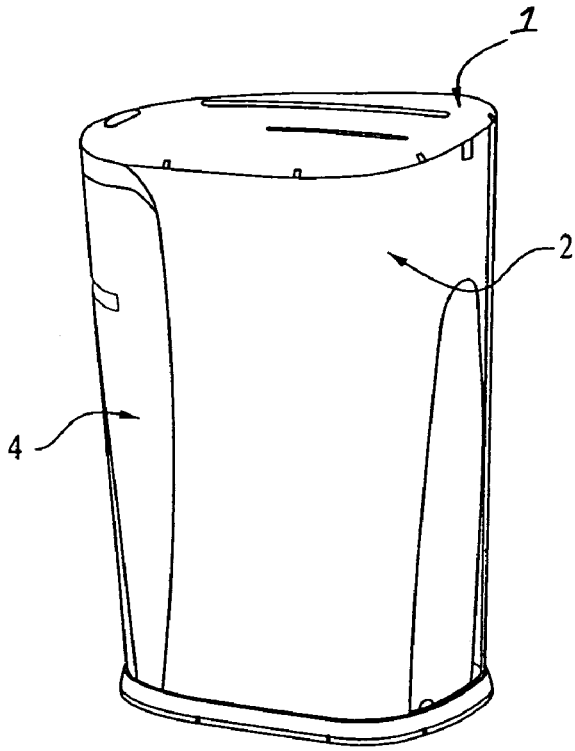
FIG. 6 is a perspective view of an apparatus embodying features of this invention with an opening in the supporting wall.
Figure 7:
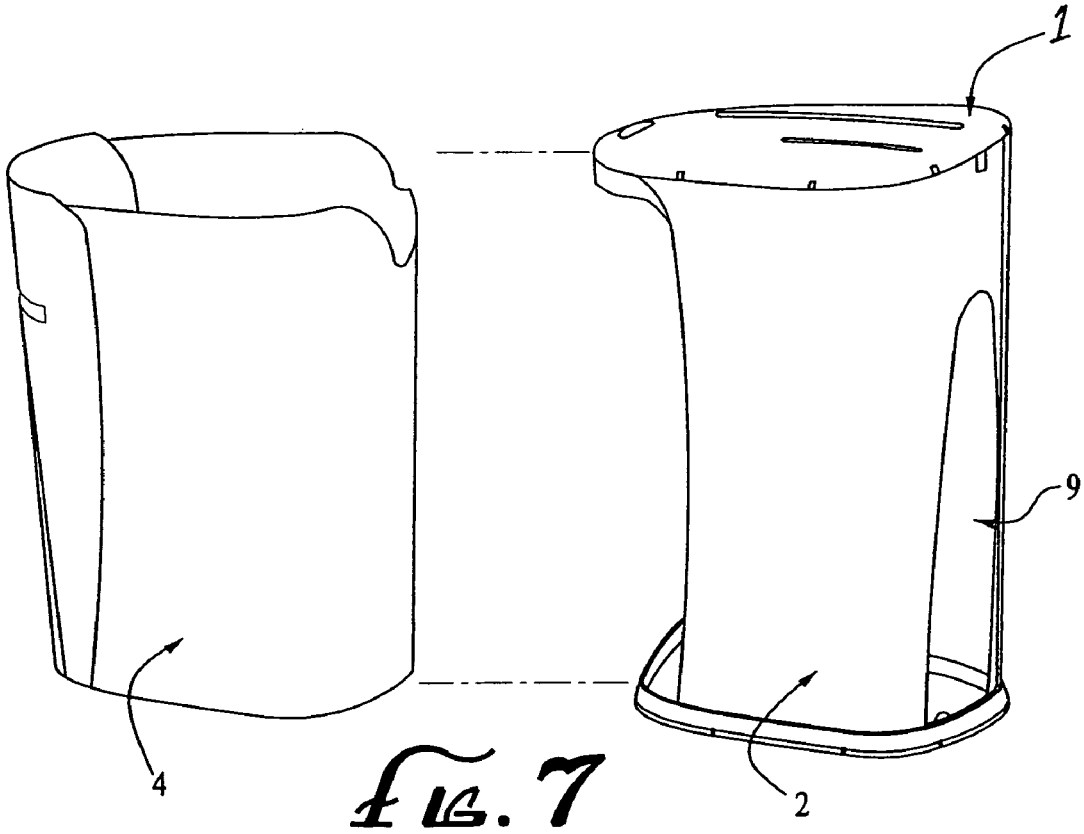
FIG. 7 is a perspective view of the waste receptacle and shredder with supporting wall with an opening for an apparatus embodying features of this invention.

FIGS. 5-7 disclose another preferred embodiment whereby the general shape of periphery of the housing 1 of the shredder is elliptical. In such a situation, there is no clear boundary differentiating between supporting walls. Such embodiments can thus be considered to have one supporting wall. In this preferred embodiment, the support wall 3 is coupled to greater than 50% of the periphery of the housing 1. There is one opening towards the front of the shredder where the waste receptacle 4 can be inserted and removed. At least one other opening 9 may be present towards the back supporting wall 3 which allows for the increased waste receptacle size. This is achieved because the depth of the waste receptacle 4 may be increased such that it fills the opening in the back of the shredder.

Figure 8:
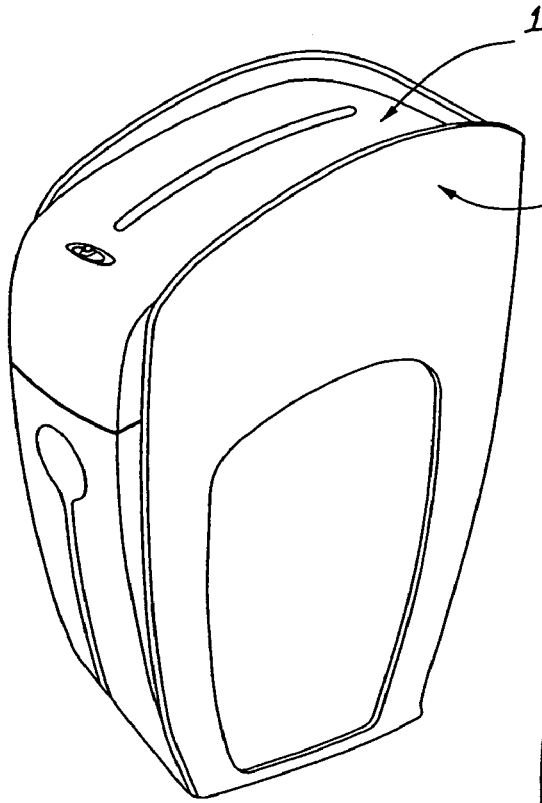
FIG. 8 is a perspective view of the waste receptacle and shredder with two supporting walls with openings for another apparatus embodying features of this invention.
Figure 9:
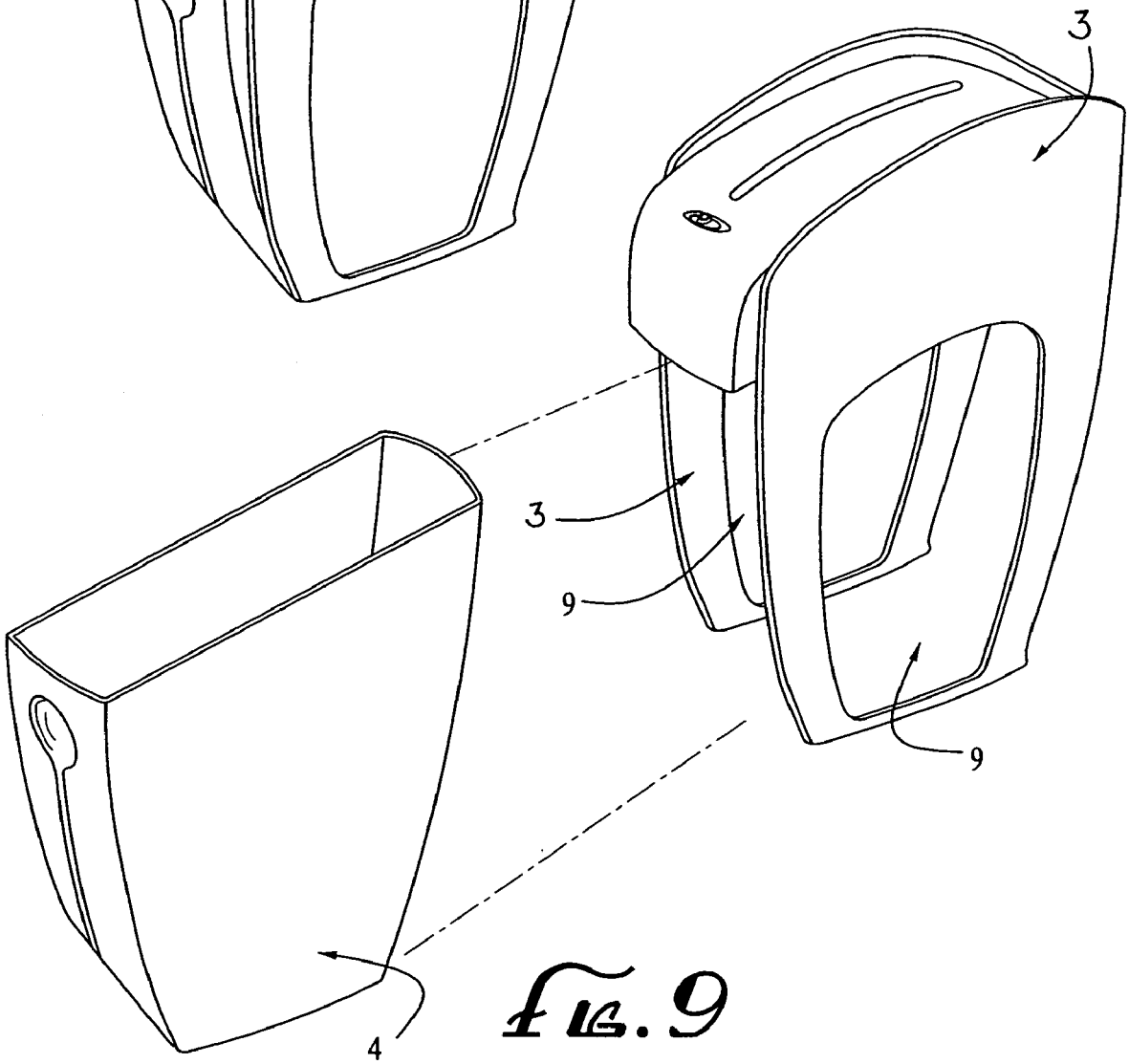
FIG. 9 is a perspective view of the waste receptacle and shredder with supporting wall with openings for an apparatus embodying features of this invention.

FIGS. 8-9 disclose other preferred embodiments of a shredder that is quadrilateral in shape, whereby the base 2 is comprised of two supporting walls 3 opposite of each other without a base bottom. In order to reduce the amount of materials needed to manufacture a shredder, the supporting walls 3 have openings 9.

Figure 10:
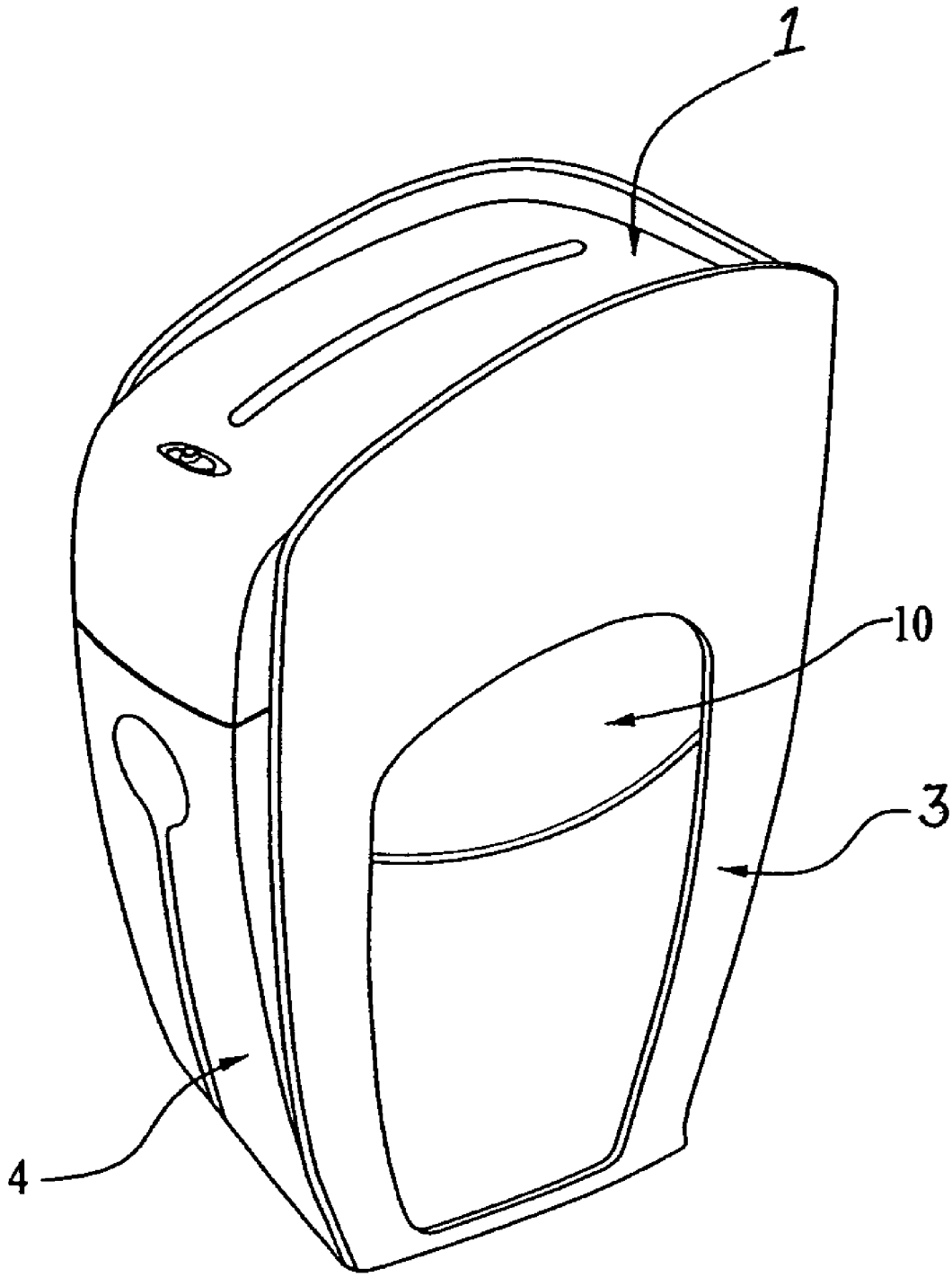
FIG. 10 is a perspective view of the waste receptacle and shredder with supporting wall with openings for an apparatus embodying features of this invention.

As seen in FIG. 10, these openings may also serve to allow the waste receptacle to extend beyond the supporting walls 3, thus allowing another input 10 for waste to be disposed of in the receptacle. This extension of the waste receptacle 4 beyond the supporting walls 3 may also be done in the embodiments demonstrated in FIGS. 5-7. In such instances the material of the waste receptacle 4 is preferably a pliable plastic so that the waste receptacle 4 can be removed from the base 2.

Although the present invention has been described in detail with respect to certain preferred versions thereof, other versions are possible. Therefore, the scope of the claims should not be limited to the description of the preferred versions contained herein.

The invention claimed is:

1. A shredder comprising:

a housing;

a shredding mechanism located inside the housing;

a base comprising a base bottom and a supporting wall, wherein said supporting wall, having a front and a rear, is coupled to greater than 50% of the periphery of the housing;

two openings in the supporting wall, wherein the first opening is located in the front of the supporting wall allowing a waste receptacle to be inserted therethrough, and the second opening is located in the rear of the supporting wall;

the waste receptacle sized to extend through the second opening when the waste receptacle is inserted through the first opening.

* * * * *